US005618214A

United States Patent [19]

Wyss et al.

[11] Patent Number: 5,618,214

[45] Date of Patent: Apr. 8, 1997

[54] APPARATUS AND METHOD FOR ERADICATING ZEBRA MUSSELS IN VESSEL RAW WATER MARINE PLUMBING SYSTEMS

[76] Inventors: Frederick B. Wyss, 1709 Birch St.; Joseph Harings, 1500 Galloway St., both of Eau Claire, Wis. 54703

[21] Appl. No.: 490,972

[22] Filed: Jun. 15, 1995

Related U.S. Application Data

[62] Division of Ser. No. 187,587, Jan. 28, 1994, abandoned.

[51] Int. Cl.[6] ..... B63H 21/38

[52] U.S. Cl. ..... 440/88; 134/169 C; 422/6

[58] Field of Search ..... 137/605, 887; 285/156; 440/88; 134/169 C; 422/6, 26, 33

[56] References Cited

U.S. PATENT DOCUMENTS

| | | | |
|---|---|---|---|
| 2,785,012 | 3/1957 | Frewin | 137/887 X |
| 4,238,131 | 12/1980 | Cleveland | 285/156 X |
| 4,271,874 | 6/1981 | Brady | 141/1 |
| 4,312,551 | 1/1982 | Mascolo et al. | 285/156 X |
| 4,919,800 | 4/1990 | Vinoski | 440/88 X |
| 4,971,366 | 11/1990 | Towsley | 285/156 X |
| 5,035,208 | 7/1991 | Culp | 123/41.14 |
| 5,142,707 | 9/1992 | Prue | 4/222 |
| 5,148,777 | 9/1992 | Brockhurst | 123/41.15 |
| 5,294,351 | 3/1994 | Clum et al. | 422/6 X |

*Primary Examiner*—John Fox
*Attorney, Agent, or Firm*—Joel D. Skinner, Jr.

[57] ABSTRACT

An apparatus for permitting the periodic introduction of a fluid into a marine plumbing system for zebra mussel control and winterization purposes, comprising:

a) a "T" shaped member having first second and third external apertures and a continuous interior passage which is communicatively connected to each aperture, the first and a second aperture further being permanently communicatively coextensive with flexible conduit members of the marine plumbing system;

b) a valve, connected to a third aperture, for controlling the ingress of zebra mussel killing fluids and antifreeze fluids, through the third aperture, into the marine plumbing system, the valve having a first end connected to the third aperture of the branched member and a second end which is connectable to an external fluid source, the valve further having a closure member and a control arm connected to the closure member;

c) a cap for connection to the valve second end; and d) clamps for connecting flexible conduit members of the marine plumbing system to the first and second apertures of the "T" shaped member.

2 Claims, 1 Drawing Sheet

APPARATUS AND METHOD FOR ERADICATING ZEBRA MUSSELS IN VESSEL RAW WATER MARINE PLUMBING SYSTEMS

This application is a division of application Ser. No. 08/187587, filed Jan. 28, 1994, now abandoned.

BACKGROUND OF THE INVENTION

1. Technical Field.

This invention pertains to fluid control systems and particularly to valves. The apparatus of this invention is useful for preventing and correcting the deleterious affects of marine mussels colonizing in marine raw water inlet systems of boats and equipment. The valve apparatus is useful for winterizing these systems where introduction of antifreeze compounds may be desired.

2. Background Information.

Raw water inlet systems, such as those commonly employed in boat engines, marine heads, and marine generators, operate most efficiently when a free and unrestricted flow of water is able to pass through them. The water is used for cooling of engines or machinery, and for flushing of sanitation devices. If the flow of water should become restricted or stopped, the effected equipment may be disabled or damaged.

It has been determined that some marine animals, particularly zebra mussels, dreissena polymorpha, will colonize in the raw water inlets of marine equipment thereby disabling or damaging the equipment. It is therefore economically advantageous to control or eliminate these colonies in boats and marine equipment. The zebra mussel is a small bivalve mollusk which has an elongated thick shell showing alternating light and dark bands. The zebra mussel is found in all of the Great Lakes and is expected to proliferate into other freshwater systems in the Midwestern and Eastern portions of the United States. The zebra mussel is believed to have a substantial negative impact on commercial and recreational boating, including damage to boat cooling and sanitation systems due to constriction of boat plumbing by colonies of the animal. Current zebra mussel control techniques involve scraping or application or chemicals such as hydrogen sulfide, chlorine, ozone, and copper sulfate. It is known that zebra mussels are sensitive to temperatures above 37 degrees C. (98.6° F.), are quickly killed at temperatures between 45°–55° C. (113°–131° F.) and are immediately killed at temperatures above 60° C. (140° F.). This property, sensitivity to heat and chemicals, is utilized by the apparatus and method of the present invention to control zebra mussel infestation.

In addition to the problems associated with zebra mussel infestation in marine plumbing systems, boats and equipment that are laid up in winter due to freezing conditions are subject to damage of their machinery and plumbing systems from internal build up of ice. It is therefore necessary to winterize this equipment by draining and/or the introduction of antifreeze compounds into the raw water systems of the equipment.

In the past, various devices and/or methods have been used or proposed, to either control zebra mussel colonization or permit marine system winterization. However, these devices and methods have significant limitations and shortcomings. And no single apparatus or method is known to have been used for both purposes.

Despite the need in the art for an apparatus and method which overcome the shortcomings and limitations of the prior art, none insofar as is known has been developed or proposed. Accordingly, it is an object of the present invention to provide an apparatus and method of use therefor, which prevents and corrects zebra mussel colonization in marine raw water inlet systems of boats and other equipment. It is also an object of this invention to provide an apparatus and method which is usable to introduce antifreeze and other compounds into the raw water inlet systems of boats and other equipment for winterization purposes. It is an additional object of the invention to provide a combined mussel control and antifreeze introduction system using a single, unitary fittng or set of fittings disposed in the marine equipment. It is a further object of this invention to provide a Zebra mussel control and marine winterization apparatus which is reliable, efficient, economical, and usable by operators and service personnel at marinas and boat yards, as well as owner operators of marine equipment, and which overcomes the limitations and shortcomings of the prior art.

SUMMARY OF THE INVENTION

The basic invention provides an apparatus for permitting the periodic introduction of a fluid into a closed conduit system, comprising:

a) a branched member having at least three external apertures and a continuous interior passage which is communicatively connected to each aperture, a first and a second aperture further being permanently communicatively coextensive with the conduit system; and b) means, connected to a third aperture, for controlling the ingress of a fluid through the third aperture.

In a preferred embodiment, the invention is for use in a marine plumbing system for zebra mussel control and winterization purposes and consists of:

a) a "T" shaped member having first second and third external apertures and a continuous interior passage which is communicatively connected to each aperture, the first and a second aperture further being permanently communicatively coextensive with flexible conduit members of the marine plumbing system;

b) a valve, connected to a third aperture, for controlling the ingress of marine mollusk killing fluids and antifreeze fluids, through the third aperture, into the marine plumbing system, the valve having a first end connected to the third aperture of the branched member and a second end which is connectable to an external fluid source, the valve further having a closure member and a control and connected to the closure member;

c) a cap for connection to the valve second end; and d) means for clamping flexible conduit members of the marine plumbing system to the first and second apertures of the "T" shaped member.

The benefits of this invention will become clear from the following description by reference to the drawings.

DESCRIPTION OF THE PREFERRED EMBODIMENT

The apparatus of the present invention is for control of mussels in raw water systems of boats and marine equipment, such as boat engines, marine heads and marine generators, and for introducing antifreeze compounds thereinto.

Figure 1:
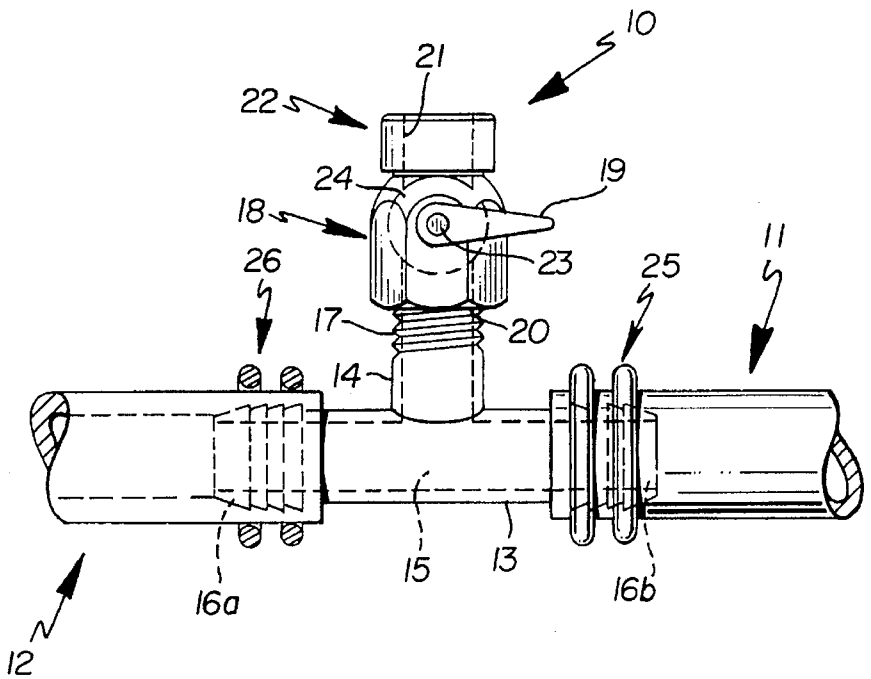
FIG. 1 is a side view of the valve apparatus of the present invention, also showing certain internal features thereof.

As shown in FIG. 1, the valve 10 of the present invention is connected to a pair of conduits 11 and 12, for example hoses, which are part of the typical plumbing system of a boat. The valve 10 basically comprises a "T" shaped member or tee 13 and a valve member or housing 18. The T-member 13 is preferably constructed of brass/bronze, but may alternatively be constructed of plastic. The valve member 18 is preferably constructed of brass and stainless steel and may be constructed of plastic.

The T-member 13 consists of a run segment 15 having a pair of ends 16*a* and *b*, and a branch segment 14 having a threaded end or nipple 17. The run segment ends 16*a* and *b* are shown to have hose barbs which promote a tight seal between the ends 16*a* and *b* and the flexible hoses 11 and 12. During installation of the valve apparatus 10, the hoses 11 and 12 may be formed by curing a unitary length of hose or conduit at the point at which the valve 10 is sought to be installed. In this example, the hose 11 leads to the interior of the marine plumbing system and the hose 12 leads to the exterior environment. The hoses 11 and 12 are connected to the ends 16*a* and *b* via clamps 25 and 26.

The valve housing 18 has a first end 20 with interior threads, a second end 21 with exterior threads, and a valve handle 19. The first end 20 is connected to the end 17 of the T-member 13. The second end 21 is for connection to a hot water or chemical source as is described further below. The second end 21 is shown having a screw on cap 22 connected to it. The cap 22 is put in place when the valve 10 is not being used in a mussel cleaning or winterization procedure, and is removed to perform such procedure. The cap 22 provides a back-up to the closed valve housing 18 during non use to prevent leakage of fluids from the marine system. In an alternative embodiment, the second end 21 has a coupler attached to it. A variety of couplers are known in the art.

The valve handle or control arm 19 is an elongated structure which may be grasped by the hand of the operator and is connected at one end to a rotatable shaft 23 which extends transversely into the valve housing 18. A valve flap or plate 24 is pivotably disposed in an interior chamber of the housing 18 and is connected to the shaft 23. The valve flap 24 has a circular configuration is used to open and close the housing 18 to either permit or prevent the flow of fluid therethrough. As shown, the valve 10 is "closed" when the arm 19 is oriented transversely with respect to the branch segment 14, and "open" when it is oriented longitudinally.

Figure 2:
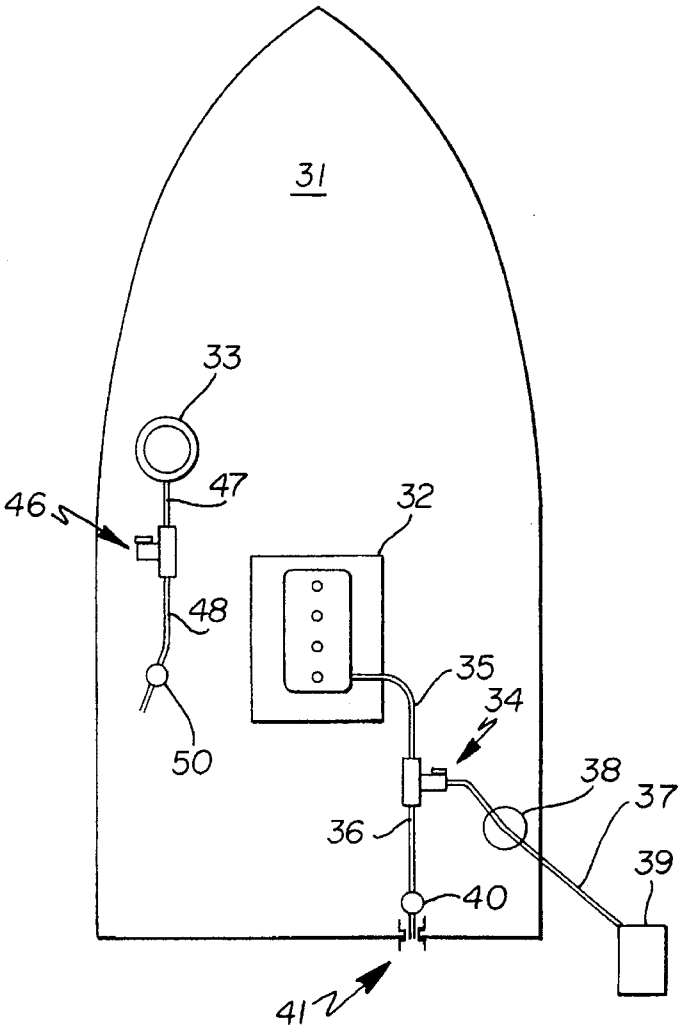
FIG. 2 is a plan view of a typical system installation including a raw water system, two of the valves of this invention, and hot water or chemical source.

Referring to FIG. 2, a typical installation of machinery and sanitation equipment is diagrammatically shown. A boat hull 31, contains an engine or motor 32 and a marine sanitation device 33, such as a toilet. Water for cooling the engine 32 or flushing the sanitation device 33 is drawn into the boat 31 via a seacock 40 or 50 disposed near a hull firing 41 and passes through a valve apparatus 34 or 46 provided by this invention on its way to the engine 32 or sanitary system 33 and its associated plumbing 35 and 36 or 47 and 48, respectively. The water inlet plumbing is where a zebra mussel colony would typically be found. The assembly 34, for example, is shown disposed in the raw water inlet plumbing immediately inboard of the through hull fitting 41 and/or seacock 40.

In a zebra mussel eradication procedure, hot water is conducted from a hot water source 39 such as a heater/holding tank to assembly 34 by a hose assembly 37 connected to the assembly 34. The rate of flow and amount of hot water is controlled by a valve 38 disposed in the hose assembly 37. After the hot water hose 37 has been attached to the assembly 34, the valve 24 in the assembly 34 is opened, pressure from the hot water system causes flow of hot water through the hose 37, through the tee of the assembly 34 and into the inlet plumbing 35, 32 and 36. The hot water displaces the relatively cool water in the plumbing system and flows over any mussel colony present. Hot water is circulated for approximately five (5) minutes. Hot water of at least 110° F. (a temperature of 140° F. is preferred) is injected into the raw water system. This hot water will kill mussels and their larvae that may be present in the system. After completion of the procedure, the hose 38 is disconnected from the assembly 34 and the safety cap is replaced to prevent loss of cooling water should the valve on the assembly 34 be accidentally opened. In an alterative procedure, for use when the boat or equipment is located out of the water, a chemical such as bleach or copper sulfate may be injected into the raw water system to destroy the mussels and larvae. The chemical may be injected using either a hand operated or electrically operated pump.

To winterize the engine 32 and its associated plumbing, the seacock 40 is closed and a hose is routed from the assembly 34 to an antifreeze container. The valve on the assembly is opened and the engine 32 is started. The existing sea water pump on the engine 32 draws in the antifreeze and it displaces the raw water in the engine, thus protecting the engine 32 and the associated plumbing from damage caused by ice.

As can be seen from the discussion above, the mussel the management system is preferably of two types. The first is for out of water service, consisting of a portable chemical or hot water pump and installed tee assemblies 34 and 46 which may be used by the owner/operator or specialized service personnel. The second consists of a permanently installed hot water source 39, and installed tee assemblies 34 and 46. Boats and equipment with the tees 34 and 46 are brought to a service dock having the hot water source 39 installed on it. Service personnel then perform the hot water flush.

As many changes are possible to the embodiments of this invention utilizing the teachings thereof, the descriptions above and the accompanying drawings should be interpreted in the illustrative and not the limited sense.

That which is claimed is:

1. An apparatus for eradicating zebra mussels in a raw water marine plumbing system of a vessel by permitting the periodic introduction of hot water of a temperature of at least 110 degrees F. into the marine plumbing system, comprising:

(a) a tee assembly for connection at a predetermined point on a conduit member of the marine plumbing system, comprising:

i) a "T" shaped member having first, second and third external apertures and a continuous interior passage which is communicatively connected to each aperture, said first and a second said aperture further being permanently communicatively coextensive with flexible conduit members of the marine plumbing system, said first and second apertures having a barbed configuration for mating with the conduit members of the marine plumbing system;

ii) a closure valve, connected to said third aperture, for permitting the ingress of hot water, through said third aperture, into the marine plumbing system, said valve having a first end connected to said third aperture of said branched member and a second end which is connectable to an external fluid source, said second end having an exteriorly threaded, male-type configuration, said valve further having a closure member and a control arm connected to said closure member;

iii) a cap having an interiorly threaded, female-type configuration for connection to said valve second end; and iv) means for clamping conduit members of the marine plumbing system to said first and second apertures of said "T" shaped member (b) a source of hot water of at least 110 degrees F.; and (c) a connection conduit connecting said hot water source to said tee assembly, said connection conduit having an interiorly threaded, female-type connection for mating with said valve second end.

2. A method of eradicating zebra mussels in a raw water marine plumbing system of a vessel, comprising the steps of:

(a) attaching a tee assembly to a predetermined point on a conduit of the marine plumbing system, said tee assembly comprising:

i) a "T" shaped member having first, second and third external apertures and a continuous interior passage which is communicatively connected to each aperture, said first and second said aperture further being permanently communicatively coextensive with the marine plumbing system; and ii) a closure valve, connected to said third aperture, for permitting the ingress of hot water, through said third aperture, into the marine plumbing system, said valve having a connection end;

(b) attaching a hot water source to said connection end of said valve;

(c) opening said valve so that said third aperture is coextensive with the marine plumbing system; and (c) providing hot water of at least 110 degrees F. from said hot water source to said valve, whereby said hot water enters the marine plumbing system and eradicates zebra mussels by increasing the temperature of fie system environment beyond that which is survivable by zebra mussels.

* * * * *